United States Patent [19]

Edmisson et al.

[11] 4,087,935

[45] May 9, 1978

[54] TOY VEHICLE WITH HOUSING

[75] Inventors: Russell Curtis Edmisson, Manhattan Beach; Herbert May, Torrance; Raymond Marie St. Pierre, Hawthorne, all of Calif.

[73] Assignee: Mattel, Inc., Hawthorne, Calif.

[21] Appl. No.: 745,107

[22] Filed: Nov. 26, 1976

[51] Int. Cl.[2] ..... A63H 17/14; A63H 29/20

[52] U.S. Cl. ..... 46/202; 46/206

[58] Field of Search ..... 46/11, 202, 206, 209

[56] References Cited

U.S. PATENT DOCUMENTS

| | | | |
|---|---|---|---|
| 2,050,892 | 8/1936 | Marx | 46/202 |
| 2,731,765 | 1/1956 | Carver | 46/209 |
| 3,471,963 | 10/1969 | Tomiyama | 46/209 |
| 3,735,525 | 5/1973 | Freed | 46/202 |
| 3,798,832 | 3/1974 | Terzian | 46/206 |
| 3,895,458 | 7/1975 | Lemelson | 46/202 |

*Primary Examiner*—Louis G. Mancene
*Assistant Examiner*—Robert F. Cutting
*Attorney, Agent, or Firm*—John G. Mesaros; Max E. Shirk; Stephen L. King

[57] ABSTRACT

A toy vehicle having an inertia motor and a wheel adapted to be driven thereby, the vehicle having a drive gear operatively connected to the intertia motor, the periphery of the gear extending partially below the surface of the vehicle. A housing in the form of a fire station or the like is provided with a simulated chimney, which has a rack on the surface thereof within the housing, the chimney being depressible to operate a pinion carrying an enlarged diameter drum, having one end of a strap secured thereto for winding around the drum. The housing is provided with a ramp surface adapted for supporting the vehicle, the ramp being provided with a rotatably mounted hollow shaft having a power gear for engaging the drive gear within the vehicle, the power gear having a coil spring wound about a rod on the axis thereof with the outer end of the hollow shaft being configured to provide a small diameter drum having the other end of the strap means secured thereto. Restraining means are provided for engaging the vehicle so that upon depression of the rack the power gear is maintained in engagement with the drive gear, the power gear ceasing rotation when the rack is depressed to its extreme position whereby the inertia motor is energized and the vehicle leaves the housing.

7 Claims, 5 Drawing Figures

TOY VEHICLE WITH HOUSING

BACKGROUND OF THE INVENTION

The background of the invention will be discussed in two parts:

1. Field of the Invention

This invention relates to toys and more particularly to an inertia motor operated toy vehicle having the inertia motor energized by placement of the vehicle in a housing which contains the means for energizing the motor.

2. Description of the Prior Art

Toys which include vehicles utilizing inertia motors are well known in the prior art.

Such vehicles generally, have the motors energized by the child repeatedly moving the vehicle over a flat surface and then placing the vehicle by hand on a flat surface to be driven by the drive wheels.

Other toys have been developed utilizing a toy vehicle with an inertia motor in conjunction with a base member or a housing for accelerating the inertia motor prior to release.

One type of device is shown in U.S. Pat. No. 2,731,765 entitled "Toy Emergency Vehicle with Housing" issued Jan. 24, 1956, to Carver and discloses a housing having a ramp surface with a crank accessible externally of the housing, rotation of the crank rotating a pair of drive wheels in the ramps to thereby energize the rear wheels of the vehicle carrying the inertia motor. The housing is configured to have the rear bumper of the vehicle abutting against the rear wall of the housing with spring means in the ceiling of the housing, the spring being biased against the roof of the vehicle.

Another device utilizing an inertia motor operated vehicle is shown in U.S. Pat. NO. 3,895,458 entitled "Toy Mechanism" issued to Lemelson on July 22,1975, the device including a base member having an inertia wheel rotated by a separate gear strip. In these types of toys, once the gear strip is lost it must be replaced or the toy is useless.

Other prior art is set forth in a separate communication to the Patent Office, and is listed by way of illustration and not of limitation. The present invention exemplifies improvements over this prior art.

SUMMARY OF THE INVENTION

It is an object of this invention to provide a new and improved toy including a vehicle having an inertia motor and a housing containing means for energizing the motor.

It is another object of this invention to provide a rack operated means within the housing for energizing the inertia motor of the vehicle.

The foregoing and other objects of the invention are accomplished by providing a toy vehicle having an inertia motor and a wheel driven thereby, the vehicle being provided with a drive gear coupled to the motor. The housing contains a surface for supporting the vehicle, the surface having in proximity thereto, a power gear adapted to coact with the drive gear. The power gear has coupled to one end of its shaft a small diameter drum which has secured thereto one end of a strap, the other end being secured to a large diameter drum within the housing which has rotatably secured to its shaft a pinion member coacting with a rack slidably mounted within the housing, the rack being in the form of a simulated chimney. The housing has an internal portion thereof configured for at least partially restraining the vehicle during actuation of the rack to maintain the drive gear in engagement with the power gear.

The foregoing and other objects of the invention will become apparent from the specification when taken in conjunction with the drawings.

DESCRIPTION OF THE PREFERRED EMBODIMENT

Figure 1:
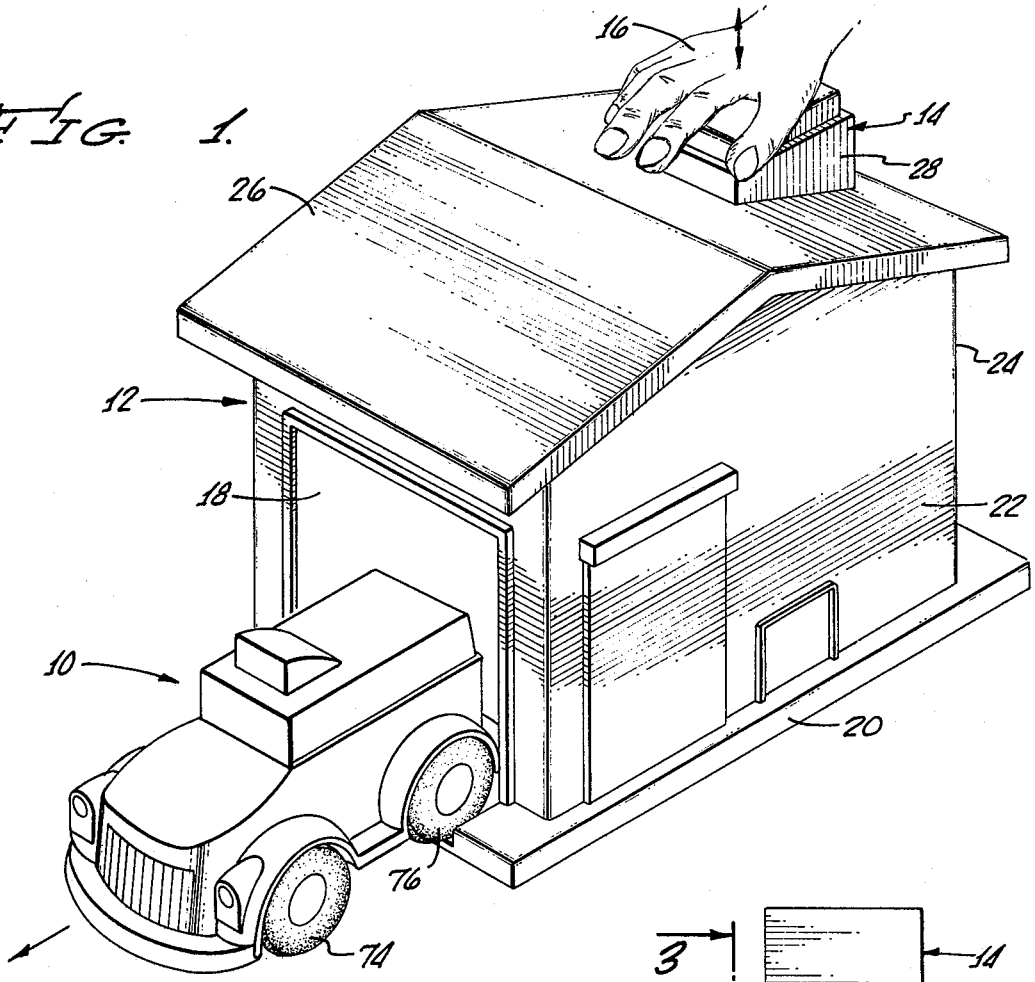
FIG. 1 is a perspective view of the toy vehicle and housing therefor in accordance with the invention.

Referring now to the drawings and particularly to FIG. 1, there is shown a vehicle 10, which simulates an emergency vehicle, such as a fire truck or the like. The vehicle is adapted to be propelled from a housing 12 by means of depressiion of a plunger 14, which simulates a chimney with a closed top, for example, by a child pushing down with his hands 16. The housing 12 can be in the form of a simulated structure for housing a vehicle, for example, an emergency station such as a fire house or the like, and includes a garage opening 18 for insertion of the vehicle as well as, of course, departure of the vehicle 10. The housing 12 has a base member 20 adapted for engaging a surface such as a floor or the like, and supports an enclosure including a pair of upwardly extending side walls 22 and rear wall 24. The housing 12 is covered by a suitable roof 26 which has a portion thereof configured to define an opening which is polygonal or square in cross section and adapted to provide an upper guide opening 28 for the plunger 14. Although shown as a fire station and fire truck, it is to be understood that other vehicle containing structures, such as a barn, may be simulated, with the plunger 12 configured to simulate a silo or cupola or the like.

Figure 2:
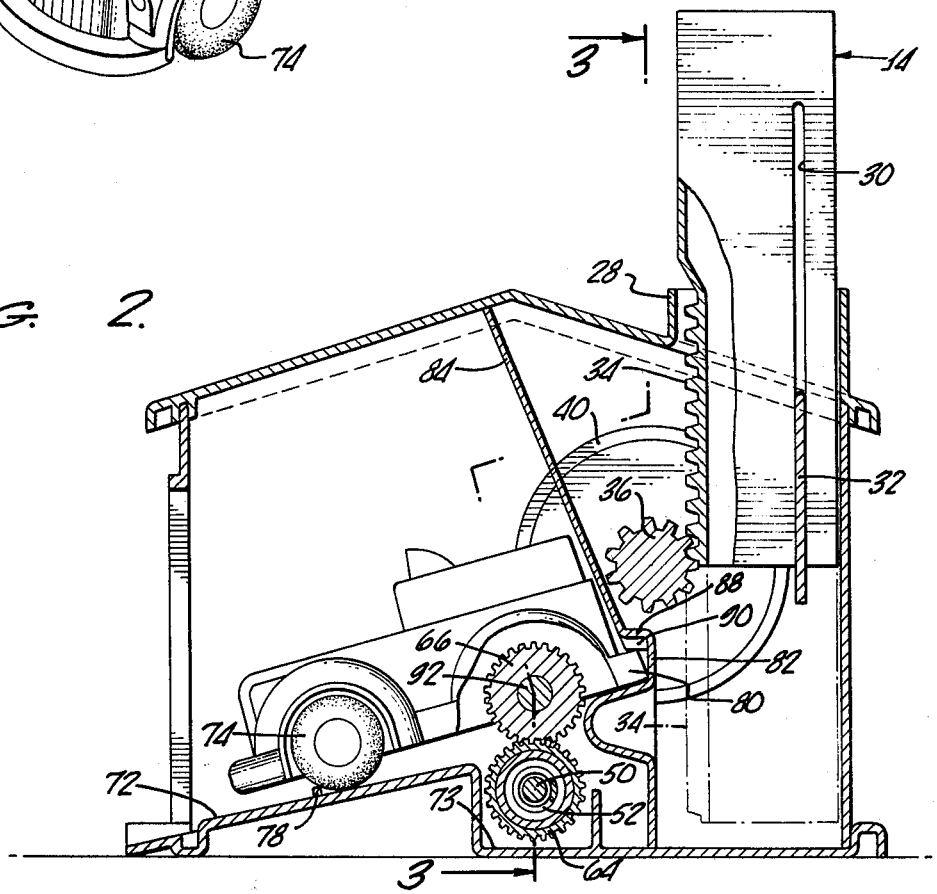
FIG. 2 is a partial cross sectional view of the housing and vehicle of FIG. 1.
Figure 3:
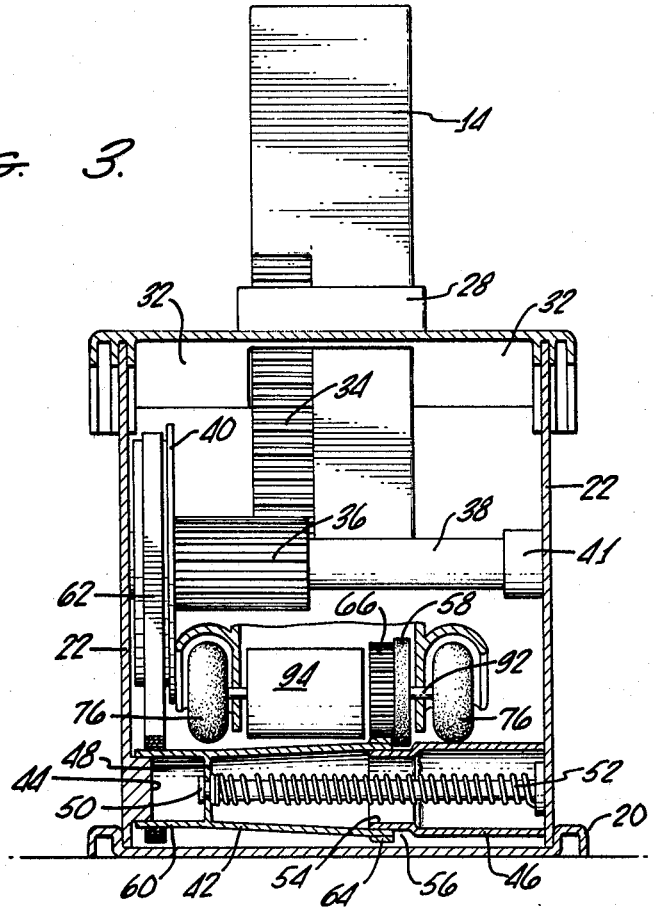
FIG. 3 is a cross sectional view taken along line 3–3 of FIG. 2.
Figure 5:
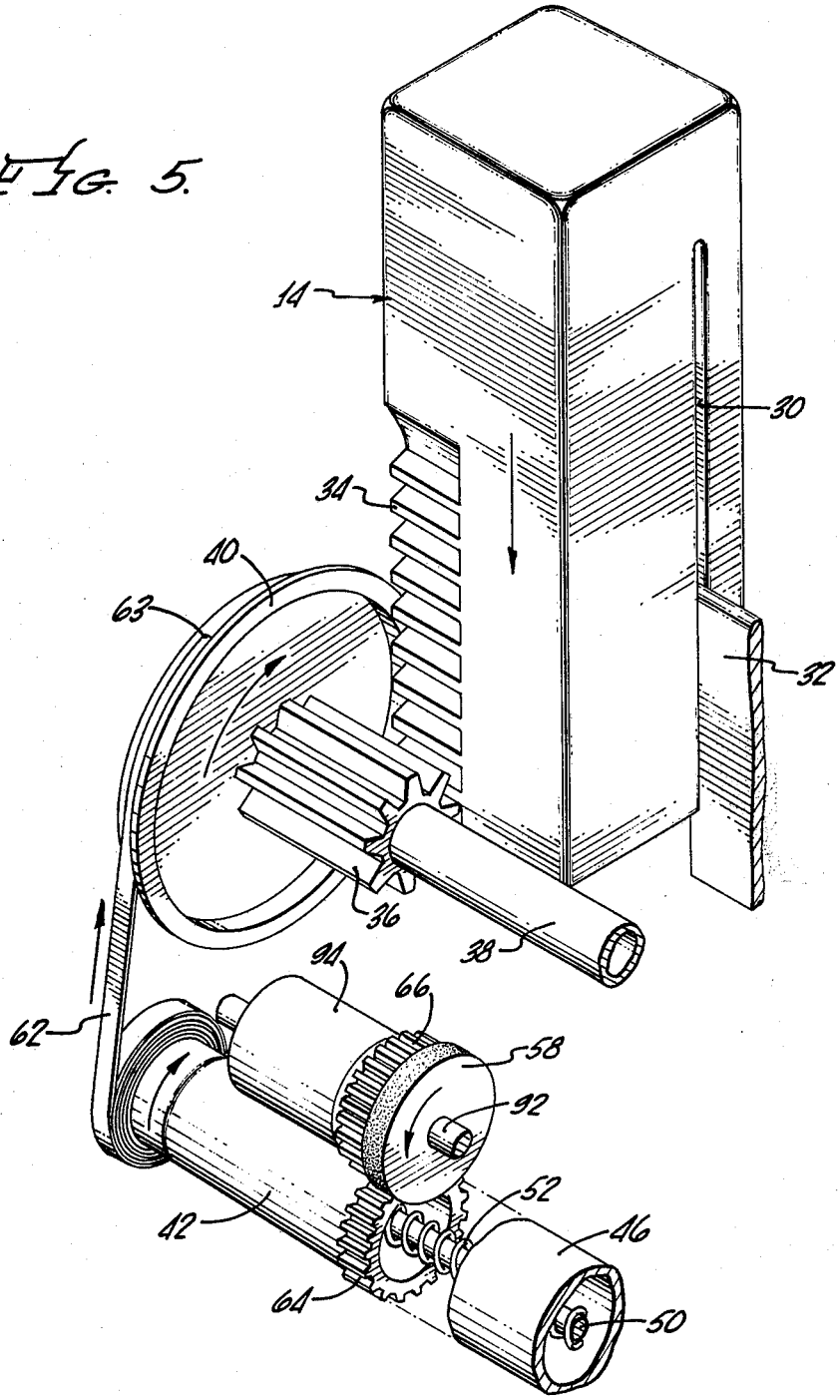
FIG. 5 is an enlarged perspective view of the main operating components of the vehicle and housing shown in FIG. 1.

As shown in FIGS. 2, 3, and 5, the plunger 14 is adjacent rear wall 24 and has longitudinally extending grooves 30 in opposite surfaces thereof, the grooves 30 being adapted to slidably engage guide ribs 32 formed on the interior of the side walls 22 of the housing 12, the configuration of grooves 30 and guide ribs 32 being such to permit depression of plunger 14 along a line perpendicular to the plane of the base 20.

The plunger 14 is formed, for example, by a molding process, and molded integrally in the surface of one portion of the plunger 14 is a toothed gear strip or rack 34 which meshes with a pinion gear 36 rotatably mounted within the housing on a line generally parallel to the base member 20 and transverse to the direction of travel of vehicle 10. The pinion 36 is carried by a shaft 38 which has one end thereof positioned in a bearing socket 41 formed on the inner surface of side wall 22, while the other end of the shaft 38 carries a large diameter drum 40, the adjacent end of shaft 38 being secured in a similar bearing socket on the other side wall 22 of housing 12. The pinion gear 36 and drum 40 are formed integrally with shaft 38. The rack 34 is configured to be contained substantially within the confines of the housing 12 as well as the guide opening 28 of the roof 26 to prevent any gear teeth from being exposed to a child utilizing the toy. The pinion 36 has a diameter substantially less than the diameter of the large drum 40 for reasons which will hereafter become obvious.

Positioned on an axis parallel to the axis of shaft 38 adjacent the base 20 is a hollow shaft 42 having one end thereof secured by a male bearing projection 44 formed within the interior of one side wall 22 of the housing 12. The hollow shaft 42 is tapered in cross section with the other end forming a slightly enlarged opening engaging an elongate hollow male bearing projection 46 formed on the interior surface of the opposite side wall 22 of the housing 12. The hollow shaft 42 is provided with an integral interior web portion 48 intermediate the opposing ends thereof, the web portion 48 having an aperture extending therethrough for rotatably receiving a rod 50 having wound thereabout a torsional coil spring 52 with one end thereof secured to the web 48 and the other end thereof secured to the inner surface of side wall 22 within the hollow male bearing projection 46. The coil spring 52 has one end effectively fixed to the side wall 22 while the other end winds along with hollow shaft 42 about rod 50, the coil spring being pre-wound to bias the hollow shaft 42 in a counter-clockwise direction as viewed in FIG. 5. The male bearing projection 46 is provided with a reduced diameter bearing portion 54 which provides a gap 56 between the point of engagement with the end of hollow shaft 42 and the rest of projection 46, this gap being provided to permit a drive wheel 58 of the vehicle 10 to rest therein without contacting any adjacent interior surface of the housing 12 during the inertia motor energizing operation.

The end of hollow shaft 42 connected to bearing projection 44 is configured to provide a smaller diameter drum 60, which has secured thereto one end of a strap 62 which is wound about the drum 60 several times, the other end of strap 62 being secured to the drum 40 as indicated at 63. The other end of hollow shaft 42 has secured thereto or formed integrally therewith a power gear 64 adapted to coact with a drive gear 66 carried by the vehicle 10, the drive gear 66 being couplet to the drive wheel 58 of the vehicle 10.

As best illustrated in FIG. 5, the power transfer mechanism or motor energizing mechanism contained within the housing 12 includes the plunger 14 having the rack 34 therein meshing with the pinion 36. When plunger 14 is depressed in the direction indicated by the arrow thereon, the pinion 36 along with the enlarged diameter drum 40 rotates in the clockwise direction as indicated by the arrow thereon. Through the coupling means provided by flexible strap 62, the hollow shaft 42 likewise rotates in the clockwise direction as indicated by the arrow thereon against the force of the biasing member or coil spring 52, which urges the hollow shaft 42 in the counter-clockwise direction. Rotation of shaft 42 thereby rotates power gear 64 in the clockwise direction to rotate drive gear 66 along with drive wheel 58 in the counter-clockwise direction as indicated by the arrow thereon. The dimensions of the various parts are such that the power gear 64 is rotated between two and one-half and three rotations for one depression of plunger 14 from its first position, the position shown in solid lines in FIG. 2, to its second position which would be the position with the plunger 14 fully depressed as shown in dotted lines.

Figure 4:
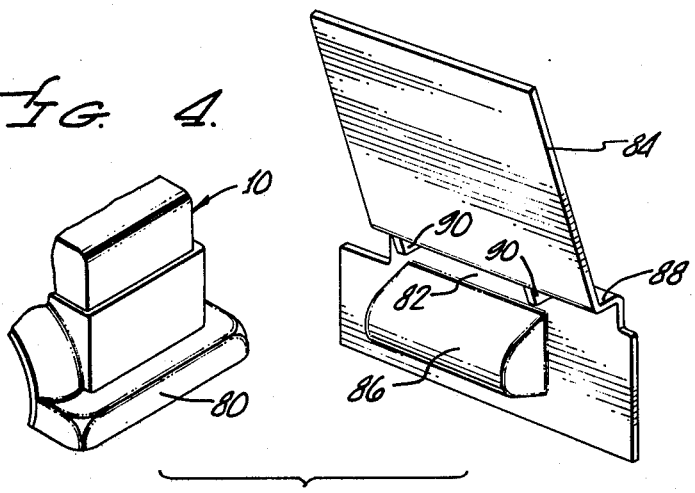
FIG. 4 is an exploded perspective view, partially broken away, of the vehicle and the restraining shield.

Referring now to FIG. 2, the vehicle 10 is shown in position in housing 12. The base 20 is configured to provide a ramp surface 72 adapted to support the vehicle 10, which is conventionally configured with a pair of freely rotatable front wheels 74 and a pair of rear wheels 76. The ramp 72 is provided with a stop projection 78 which is configured and positioned to abut against the front of one of the front tires 74 to assist in retaining the vehicle 10 on ramp surface 72 against the force of gravity. Rearwardly of ramp 72, the base 20 is configured to provide a trough 73 into which is positioned the power gear 64 along with the hollow shaft 42. The vehicle 10 is provided with a simulated rear bumper 80 which fits within a recess 82 formed in a shield member 84 which extends transversely within the housing 12 between the opposing side walls 22 as well as from the base member 20 to the roof 26 thereof. The shield 84 serves a two-fold purpose, one of which is for safety purposes, that is, to cover the moving rack 34 and pinion 36. The other purpose is to restrain the vehicle 10 during operation of the toy to maintain the power gear 64 meshing with the drive gear 66. As better illustrated in FIG. 4, along with FIG. 2, the shield 84 is configured with a transversely extending protuberance 86 adjacent the bottom portion thereof, the protuberance 86 having a width generally the same as the width of the bumper 80 of the vehicle 10. The protuberance 86 extends inwardly toward ramp surface 72 and defines one end of the recess 82, the other end of recess 82 being defined by an inwardly extending bent portion 88 of shield 84, the bent portion 88 having downwardly extending restraining tabs 90 integral therewith, the lower edges of tabs 90 being adapted for engaging the upper surface of bumper 80 of the vehicle 10.

Referring now to FIGS. 3 and 5, the details pertaining to the vehicle propulsion system will be described. The rear wheels 76 are loosely mounted on an axle 92, the axle 92 having affixed thereto the inertia motor which includes the drive wheel 58, which is directly coupled to the drive gear 66. Rotatably mounted on axle 92 is a large cylindrical inertia motor mass 94 which is metal and either direct coupled to drive gear 66, or coupled through gearing such that the inertia motor mass 94 rotates more rapidly than the drive gear 66. In either event, the drive wheel 58 is so disposed with respect to the bottom surface of the vehicle 10 that the drive wheel 58 is the primary source of engagement with the surface upon which the vehicle 10 is intended to roll. The diameter of rear tire 76 is slightly smaller than the diameter of drive wheel 58 which is composed of rubber or plastic, or the like. The diameter of the drive gear 66 is slightly smaller than that of drive wheel 58 while the diameter of the inertia motor mass 94 is approximately the same as or slightly smaller than the diameter of drive wheel 66. The front wheels 74 are conventionally mounted on a second axle for rotation upon movement of the vehicle 10.

To operate the toy, the vehicle 10 is positioned within housing 12, as shown in FIG. 2, with the front wheel 74 resting against the curb or stop projection 78 of ramp 72. In this position, the drive gear 66 of the vehicle 10 is meshed with the power gear 64 carried by hollow shaft 42. The bumper 80 is resting within the recess 82 with the upper surface thereof abutting against tabs 90 and the lower surface of bumper 80 resting on protuberance 86 of the shield member 84. The drive wheel 58 is above the trough 73 in base member 20 and is displaced from contact with any internal parts due to the gap 56 adjacent the power gear 64 (see FIG. 2). In this position, the toy is ready to be operated, whereupon a child depresses the plunger 14 from its upper first position, thereby causing the rack 34 to rotate the pinion 36 in the clockwise direction (see also FIG. 5). The power gear is likewise rotated in a clockwise direction rotating the drive gear 66 in a counter-clockwise direction. The recess 82 coacting with the bumper 80 of the vehicle 10 restrains the vehicle during the operation to maintain the gear teeth of power gear 64 in meshed engagement with the gear teeth of drive gear 66. When the plunger 14 reaches its second, or lowest position, indicated by dotted lines in FIG. 2, power gear 64 ceases rotation, whereupon the inertia force of mass 94 operating with drive gear 66 causes drive gear 66 to move with respect to power gear 64 thereby propelling the vehicle 10 over the stop projection 78 out from the housing 12. Upon the vehicle 10 initiating movement, the drive wheel 58 engages the ramp surface 72 as well as, of course, the surface upon which the vehicle 10 is intended to be propelled. Upon release of the plunger 14, the coil spring 52, which has been wound upon depressing, urges the hollow shaft 42 in its normally pre-biased counter-clockwise direction to rewind strap 62 about small diameter drum 60. This rotates large diameter drum 40 in the counter-clockwise direction to return the plunger 14 to its first or upper position, the mechanism being ready to again receive the vehicle 10.

As shown, what has been provided, is a highly efficient, compact toy vehicle and housing assembly, the toy vehicle having an inertia motor, the energizing means within the housing being so constructed and so configured to provide the maximum amount of power transfer in a small space with a simple one-time depression of the plunger effecting the power transfer to the vehicle. By this configuration, a small preschool child can exert a large amount of force by pushing downwardly rather than by pulling or cranking or the like, the latter situations being somewhat complicated for a child of tender years. While there has been shown and described a preferred embodiment, it is to be understood that various other adaptations and modificatiions may be made within the spirit and scope of the invention.

What is claimed is:

1. In a toy, the combination comprising:

a toy vehicle having an inertia motor and a wheel driven thereby;

a drive gear within said vehicle coupled to said motor;

a housing having a portion thereof configured to support said vehicle;

a rack operatively connected within said housing for actuation between a first and second positions;

a pinion rotatably mounted within said housing and operable by said rack;

a large diameter drum secured to said pinion;

a power gear rotatably mounted within said housing adjacent the vehicle supporting portion;

a small diameter drum secured for rotation with said power gear;

strap means interconnecting said large diameter drum and said small diameter drum;

means within said housing adjacent said vehicle supporting portion for at least partially restraining said vehicle during actuation of said rack to maintain said drive gear in engagement with said power gear; and bias means within said housing for retaining said rack in said first position and permitting movement of said rack to said second position against the force of said bias means whereby movement of said rack from said first to said second position rotates said power gear to energize the inertia motor and stoppage of rotation of said power gear causes the vehicle to leave said housing.

2. The combination according to claim 1 wherein said strap means is a double-ended flexible strap having one end thereof secured to said large diameter drum and the other end thereof wound about and secured to said small diameter drum.

3. The combination according to claim 2 wherein said small diameter drum is formed on one end of a hollow shaft and said power gear is secured to the other end of said hollow shaft.

4. The combination according to claim 3 wherein said bias means includes a torsional coil spring mounted at least partially within said hollow shaft about a rod on the axis thereof, said spring having one end thereof secured to said hollow shaft for rotation therewith and the other end thereof secured to said housing.

5. The combination according to claim 4 wherein said rack is carried by a plunger slidably mounted within the housing, the plunger having a portion thereof external of said housing.

6. The combination according to claim 5 wherein said portion of the plunger external of the housing is configured to simulate a chimney.

7. The combination according to claim 6 wherein said vehicle has a simulated rear bumper and said means for at least partially restraining said vehicle includes a shield member configured to receive said bumper.

* * * * *